US008322463B2

(12) United States Patent
Walter

(10) Patent No.: US 8,322,463 B2
(45) Date of Patent: Dec. 4, 2012

(54) DOWN HOLE MULTIPLE PISTON TOOLS OPERATED BY PULSE GENERATION TOOLS AND METHODS FOR DRILLING

(75) Inventor: Bruno H. Walter, St. Albert (CA)

(73) Assignee: Lewal Drilling Ltd., St. Albert (CA)

( * ) Notice: Subject to any disclaimer, the term of this patent is extended or adjusted under 35 U.S.C. 154(b) by 203 days.

(21) Appl. No.: 12/515,733

(22) PCT Filed: Jan. 30, 2008

(86) PCT No.: PCT/CA2008/000190

§ 371 (c)(1),
(2), (4) Date: May 20, 2009

(87) PCT Pub. No.: WO2008/092256

PCT Pub. Date: Aug. 7, 2008

(65) Prior Publication Data

US 2010/0065330 A1 Mar. 18, 2010

Related U.S. Application Data

(60) Provisional application No. 60/887,330, filed on Jan. 30, 2007.

(51) Int. Cl.

| | |
|---|---|
| ***E21B 1/00*** | (2006.01) |
| ***E21B 1/14*** | (2006.01) |
| ***E21B 4/14*** | (2006.01) |

(52) U.S. Cl. ..... 175/62; 175/4; 175/51; 175/93; 175/296; 175/304

(58) Field of Classification Search ..... 175/4, 51, 175/62, 57, 93, 296, 126, 1, 304, 106; 166/178; 173/1, 91, 218

See application file for complete search history.

(56) References Cited

U.S. PATENT DOCUMENTS

| | | | | |
|---|---|---|---|---|
| 4,819,745 | A | 4/1989 | Walter | |
| 4,830,122 | A | 5/1989 | Walter | |
| 4,979,577 | A | 12/1990 | Walter | |
| 5,009,272 | A | 4/1991 | Walter | |
| 5,190,114 | A | 3/1993 | Walter | |
| 5,647,445 | A * | 7/1997 | Puchala | 175/296 |
| 6,047,778 | A * | 4/2000 | Coffman et al. | 173/91 |
| 6,910,542 | B1 | 6/2005 | Walter | |
| 2001/0054515 | A1 * | 12/2001 | Eddison et al. | 175/56 |
| 2002/0050359 | A1 * | 5/2002 | Eddison | 166/321 |

* cited by examiner

*Primary Examiner* — Cathleen Hutchins
(74) *Attorney, Agent, or Firm* — Oyen Wiggs Green & Mutala LLP

(57) ABSTRACT

An underground drilling method where drilling fluid pulsing down hole tool is combined with a multiple in series pistons down hole tool to provide vigorous vibrations in the drill string and deliver vibrating energy to the drill bit to increase penetration rates and reduce friction between the drill string and the hole. One example method and apparatus shown can operate a simple percussive down hole mud hammer.

10 Claims, 7 Drawing Sheets

DOWN HOLE MULTIPLE PISTON TOOLS OPERATED BY PULSE GENERATION TOOLS AND METHODS FOR DRILLING

CROSS REFERENCE TO RELATED APPLICATION

This application claims priority from U.S. patent application No. 60/887,330 filed on 30 Jan. 2007 and entitled DOWN HOLE MULTIPLE PISTON TOOLS OPERATED BY DOWN HOLE PULSE GENERATION TOOLS AND METHODS FOR DRILLING. For purposes of the United States of America, this application claims the benefit of U.S. patent application No. 60/887,330 filed on 30 Jan. 2007 which is hereby incorporated herein by reference.

TECHNICAL FIELD

The invention relates to underground drilling. In particular, the invention relates to novel under ground drilling methods which involve the creation of pulses in drilling fluid, the use of such pulses to operate down hole multiple-piston tools and the use of such pulses to increase drilling rates and reduce friction between a drill string and the well bore. The invention also relates to apparatuses adapted to practice methods of the invention.

BACKGROUND

Deep wells such as oil and gas wells are typically drilled by rotary drilling methods. Some such methods are described in Walter U.S. Pat. No. 4,979,577. Apparatus for rotary drilling typically comprises a suitably-constructed derrick. A drill string having a drill bit at its lower end is gripped and turned by a kelly on a rotary table or by a top drive.

During the course of drilling operations, drilling fluid, often called drilling mud, is pumped downwardly through the drill string. Drilling fluid exits the drill string at the drill bit and flows upwardly along the well bore to the surface. Drilling fluid caries away cuttings, such as rock chips.

The drill string is typically suspended from a block and hook arrangement on the derrick or from the top drive. The drill string comprises drill pipe, section of drill collars, and may comprise drilling tools such as reamers, drilling jars and shock tools. The drill bit is located at the extreme bottom end of the drill string.

Drilling a deep well is an extremely expensive operation. Great cost saving can be achieved if drilling can be made more rapid. A large number of factors affect the penetration rates.

The weight on the drill bit has a very significant effect on drilling penetration rates. If rock chips are adequately cleaned from the rock face at the bottom of the well hole, doubling of the weight on bit (WOB) will roughly double the penetration rate. It has been established that when the drilling fluid exits the drill bit in jets, better cleaning of the rock face is achieved. This is better explained in (Walter) U.S. Pat. No. 4,979,577. Further information on rotary drilling and penetration rates may be found in standard texts on the subject, such as Preston L. Moore's Drilling Practices Manual, published by Penn Well Publishing Co. (Tulsa, Okla.).

In an effort to increase penetration rates a number of down hole devices which exploit the water hammer effect to create pulsation of the flow of the drilling fluid have been developed. Such devices are useful in improving hydraulic cleaning of the bit and rock face. These devices are commercially used in combination with shock tools. Examples of such drilling fluid pulsing devices can be found in U.S. Pat. No. 4,819,745 (Walter), U.S. Pat. No. 4,830,122 (Walter), U.S. Pat. No. 4,979,577 (Walter), U.S. Pat. No. 5,009,272 (Walter), U.S. Pat. No. 5,190,114 (Walter).

In a typical shock tool a pressure pulse can act on a piston. This results in a force having a magnitude related to the area of the equalization piston multiplied by the amplitude of the pressure pulse. Since the area of the shock tool piston is relatively small the resulting force is beneficial but is often not significant.

There is a need for drilling methods that are more cost-effective than currently-used methods. There is a need for apparatus useful in the implementation of such methods.

SUMMARY OF THE INVENTION

This invention provides methods for underground drilling which involve combining a Fluid Pulsing Down Hole Tool and one or more Multiple In Series Pistons Down Hole Tool that can convert pressure pulses generated by the Fluid Pulsing Tool into mechanical force. By adding additional pistons in series we can generate significant mechanical force. One example of a multiple in series piston down hole tool is shown in U.S. Pat. No. 6,910,542. B1 (Walter). That patent discloses operating the down hole tool with pressure pulses generated at the surface. Generated oscillating mechanical force developed by the novel method of combining a Fluid Pulsing Down Hole Tool with Multiple In Series Down Hole Tool depending on particular design can act up or down and be used to energize the drill string, drill bit or to facilitate extraction of the drill string if it becomes stuck (in the latter case the apparatus functions as a drilling or fishing jar).

Further aspects and advantages of the invention and features of embodiments of the invention are described below and shown in the accompanying drawings.

BRIEF DESCRIPTION OF THE DRAWINGS

The accompanying drawings illustrate non-limiting embodiments of the invention.

DESCRIPTION

As required, detailed embodiments of the present invention are disclosed herein. However, it is to be understood that the disclosed embodiments are merely exemplary of the invention, which my be embodied in various forms. The following description provides specific details of example embodiments in order to provide a thorough understanding of the invention. However, the invention may be practiced without these particulars. The specific structures and function details disclosed herein are not to be viewed as limiting, but merely as a basis for the claims that may eventually be asserted and as a representative basis for teaching one skilled in the art to variously employ the present invention in virtually any appropriately-detailed structure. In other instances, well known elements have not been shown or described in detail to avoid unnecessarily obscuring the invention. Accordingly, the specification and drawings are to be regarded in an illustrative, rather than a restrictive, sense. Features shown in individual example embodiments described herein may be used also in combination with features of other embodiments described herein, The invention provides methods for combining Drilling Fluid Pulsing Down Hole Tool (Pulsar) which produces pulses in the drilling fluid with one or more Multiple In-Series Down Hole Tools. Three example multiple in-series down hole tools are described. These are referred to as (MPT-2), (MPT-1) and (MPMH).

It is not necessary that the Drilling Fluid Pulsing Down Hole Tool generate large-magnitude pulses. Down hole tools may convert even a small amplitude pressure pulse into a significant mechanical force which can be increased by adding additional pistons in series. Mechanical force will act in one or two directions. Force in one direction may be delivered by the energy that is stored in springs such as disk springs.

The Disclosed Multiple In Series Pistons Down Hole Tool as further described may be driven by positive pulses (i.e. pulses in which the pressure at the tool is increased relative to a hydrostatic pressure) or by negative pulses (i.e. pulses in which the pressure at the tool is decreased relative to the hydrostatic pressure). The pulses may be generated by a downhole pulsing device. In the alternative, pulses generated at the surface may be transmitted to the tool down the drill string. Negative or positive pulses may be generated at the surface. In embodiments where pulses are generated at the surface, a down hole pulsing device is not required.

Figure 1:
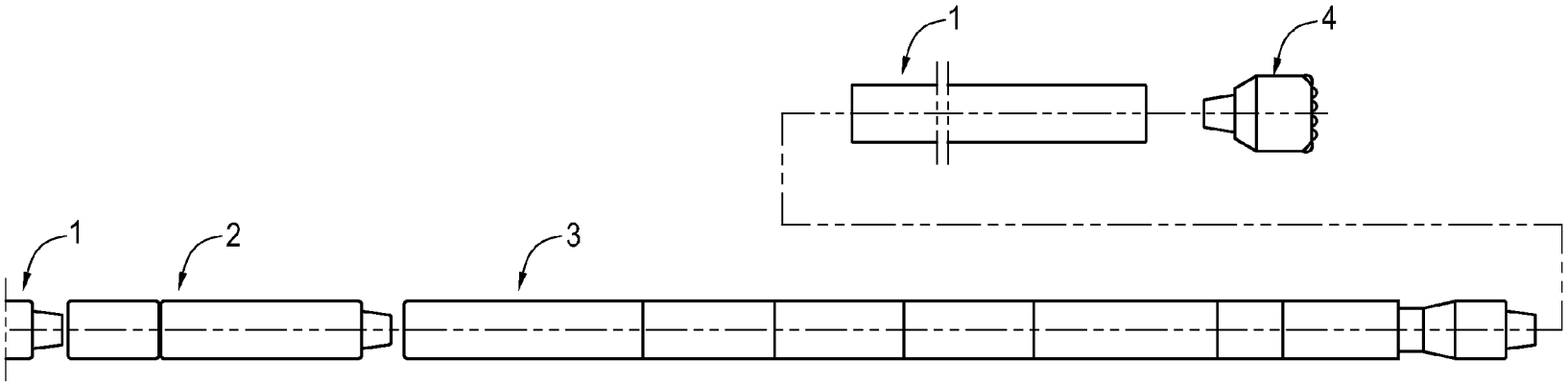
FIG. 1 is a schematic view of a placement of a drill string energizing tool (force acts in both directions) Multiple in Series Pistons Down Hole Tool (MPT-2) and Fluid Pulsing Down Hole Tool in a drill string.

FIG. 1 is a schematic view of part of a drill string in which a (Pulsar) 2 is combined with a (MPT 2) 3.

Pulsar 2 may be attached as shown in FIG. 1—under drill collars 1 or on the opposite side of the (MPT-2) 3. Below the (MPT) 3 is a section of drill collars 1 and bit sub (not shown) and drill bit 4.

Figure 2:
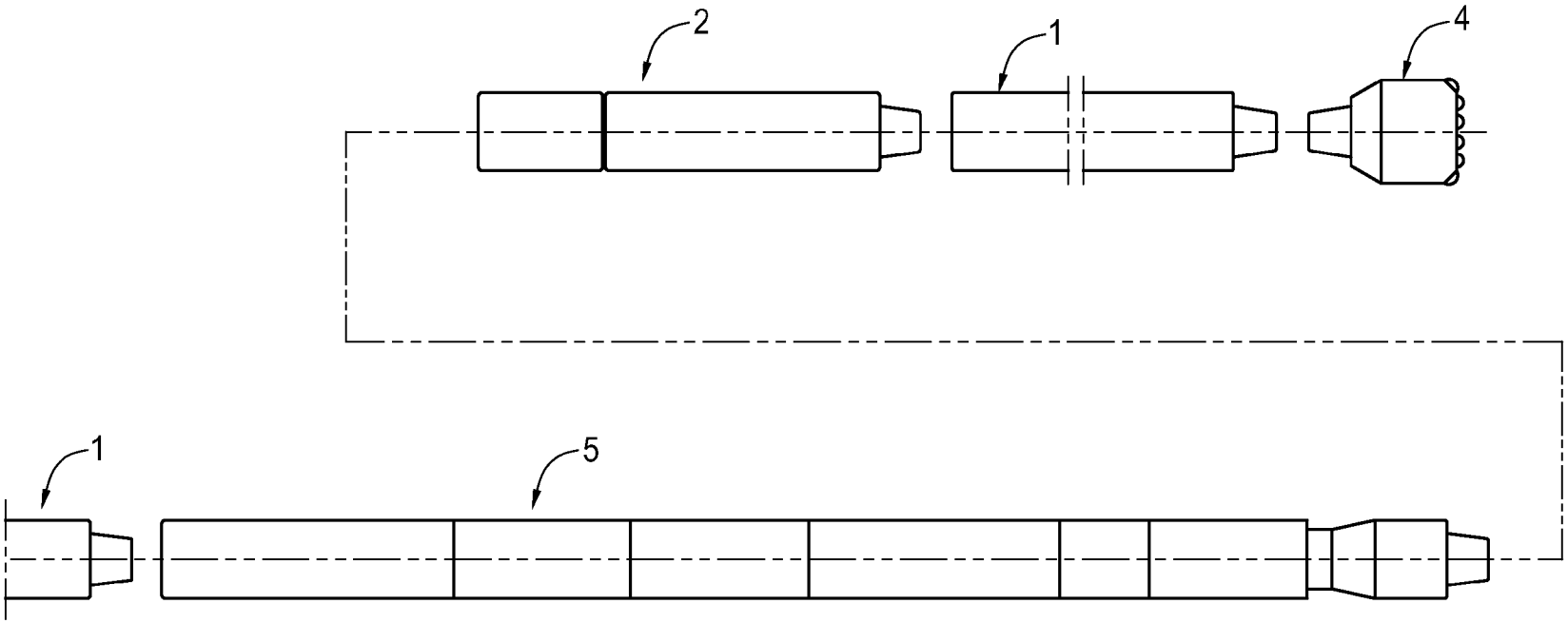
FIG. 2 is a schematic view of a placement of a drill string energizing tool (mechanical force in one direction only) Multiple in Series Pistons Down Hole Tool (MPT-1) and Drilling Fluid Pulsing Tool in a drill string.

FIG. 2 is a schematic view of a portion of a drill string in which Pulsar 2 is located below (MPT-1) (force in one direction only) 5. (MPT-1) 5 is positioned below the section of drill collars 1. Below the Pulsar 2 is a section of drill collars 1. If it is desired to energize the drill string, then this bottom section of drill collars may be replaced with a bit sub (not shown) and drill bit 4. The apparatus can also be configured so that Pulsar 2 is located above (MPT-1) 5.

Figure 3:
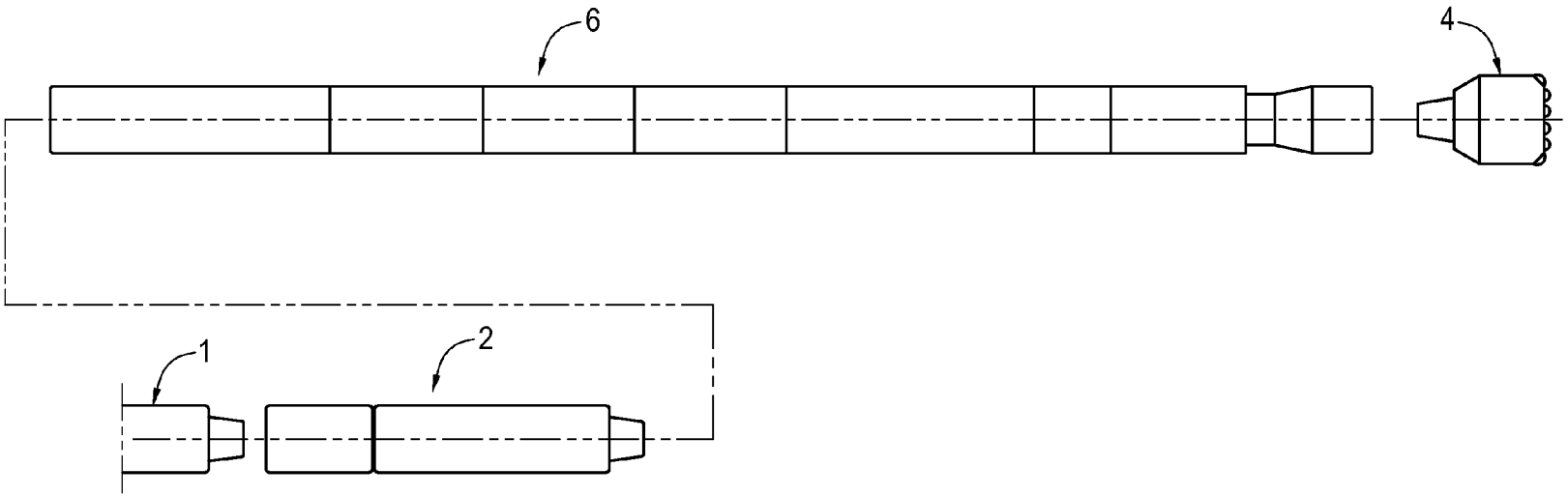
FIG. 3 is a schematic view of a placement of a Multiple Pistons Mud Hammer Tool, (Pulsar) and drill bit in a drill string.

FIG. 3 is a schematic view of a portion of a drill string in which Pulsar 2 is located below section a of drill collars 1 and above Multiple Piston Mud Hammer Tool (MPMHT) 6. Below the (MPMHT) 6 is fastened a drill bit 4 which may be a percussive, tricone or PDC bit, for example. (MPMHT) 6 will function even if Pulsar 2 is not present if repeated pressure pulses are delivered from the surface. The pressure pulses may comprise high-intensity acoustic or sonic pulses.

Figure 4:
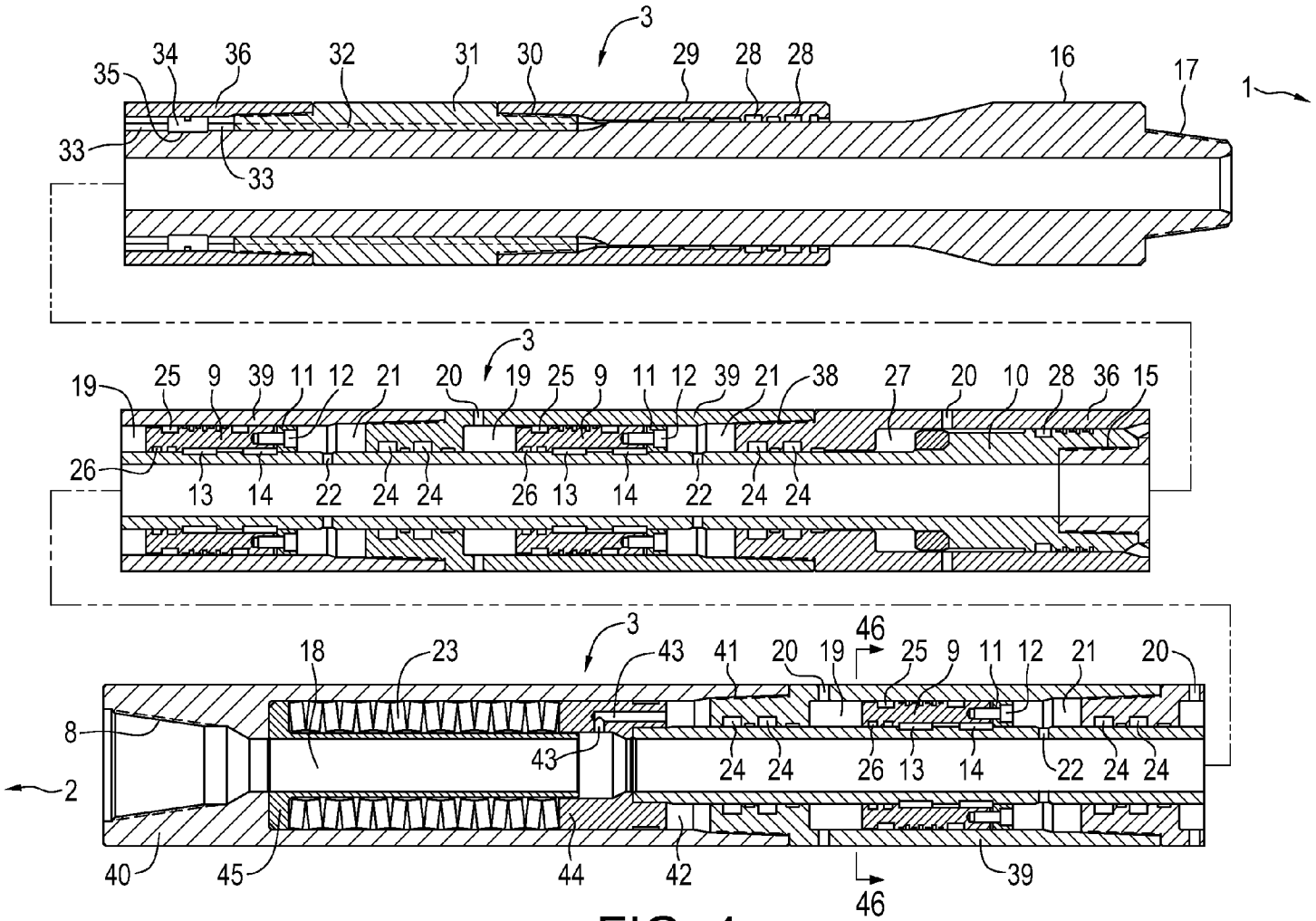
FIG. 4 is a cross section 61-61 of the (MPT-2) (capable of providing mechanical force in both directions).

FIG. 4 is a cross sectional view 61-61 (on FIG. 7) of a (MPT-2) 3. (MPT-2) 3 is connected to the bottom part of Pulsar 2 (not shown) by a female thread 8. Three pistons 9 are fastened to the piston shaft 10 by piston plates 11 which are affixed to pistons 9 by cap screws 12. Pistons 9 abut on the left side the split ring 13 and piston plate 11 contacts split rings 14. By tightening cap screw 12, pistons 9 are securely fastened to the piston shaft 10. Piston shaft 10 is connected by a threaded connection 15 to a splined mandrel 16. Splined mandrel 16 is connected by male thread 17 to the top of drill collar section 1. Drilling fluid is pumped through the drill string into the (MPT-2) 3 into the internal bore 18. Drilling fluid in the internal bore 18 is at higher pressure than the drilling fluid that is outside of the (MPT 2) 3 in the well bore. Cavity 19 above the piston 9 is connected to the outside well hole via a series of small openings 20. Cavities 21 below the pistons 9 are connected to the internal bore 18 via a series of openings 22.

The difference "dp" of the pressure inside the (MPT-2) 3 and outside of the (MPT-2) 3 acts on pistons 9 (on the faces of pistons 9). Hydraulic pressure outside of (MPT-2) 3 is lower and this pressure does not fluctuate significantly while the pressure inside (MPT-2) 3 is higher and pulsates because of pressure pulses generated by Pulsar 2. The area of all pistons 9 presented to cavities 21, when multiplied by the amplitude of the hydraulic pressure pulse in internal bore 18 creates mechanical force acting up (to the left) and lifting piston shaft 10 and splined mandrel 16 and set of pistons 9 up. While this occurs, a stack of disk springs 23 is being compressed.

When pressure in internal bore 18 drops, mechanical energy stored in spring stack 23 pushes piston shaft 10 and telescopic spline mandrel 16 down (to the right). This action will result in longitudinal oscillation of the whole drill string. "dp" between internal bore 18 and cavity 19 is sealed by seals 24. "dp" between cavity 21 and cavity 19 is sealed by seals 25 and seals 26. "dp" between cavity 27 and outside of (MPT-2) 3 (annulus of the well bore) is sealed by seals 28.

Similarly, where negative pulses are used to drive a multiple in-series pistons down hole tool, springs 23 are constructed so that they are compressed as a result of the normal working pressure differential across pistons 9. On the occurrence of a negative pulse the pressure differential is reduced and the mechanical energy stored in spring stack 23 pushes piston shaft 10 and telescopic spline mandrel 16 down (to the right). After the negative pulse has passed, the spring stack is again compressed by the normal working pressure differential between the drill string and the surrounding well bore at the location of the multiple in-series pistons down hole tool.

The assembly of piston shaft 10 and spline mandrel 16 can move telescopically (axially) in relation to the outside housing assembly 62. Outside housing 62 comprises seal housing 29 which is secured by threaded connection 30 to the female spline housing 31. Female spline 32 of the female spline housing 31 engages male spline 33 which is cut into the spline mandrel 16. In order to prevent spline mandrel 16 from being pushed out of the female spline housing 31 there is a split ring 34 that is seated in the groove 35 which is cut into the male spline 33.

Figure 5:
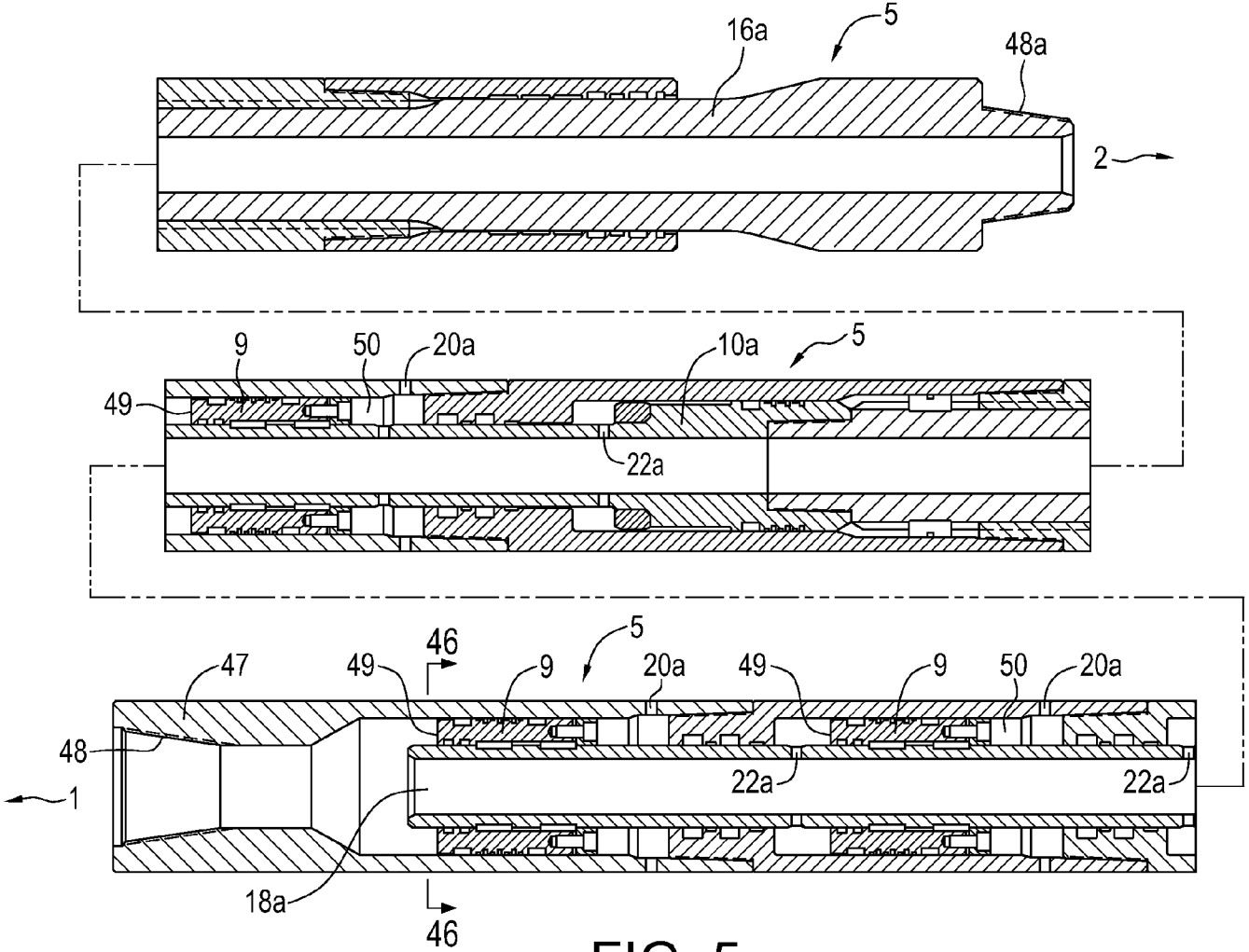
FIG. 5 is a cross section of the (MPT-1) (intended to provide mechanical force in one direction only).

FIG. 5 is a cross sectional 61-61 (see FIG. 7) view of a Multiple In Series Down Hole Tool (force in one direction only) (MPT - 1) 5. Design of (MPT - 1) 5 can be identical to the design of the (MPT - 2) 3 below the line 46-46 as shown on FIG. 4. The only difference is the location of openings 20*a* and 22*a*. Above the line 46-46 there is a top sub 47 which is connected to the bottom end of the drill collar section (not shown) via female thread 48. A bottom part of the (MPT - 1) 5 is connected to the Pulsar 2 via male thread 48A.

When periodic pressure pulses are generated by Pulsar 2 there is a pressure differential "dp" between the inside of the tool in the bore 18*a* and the pressure outside of the tool in the well bore. This "dp" acts on active areas 49 of pistons 9. When pressure inside the tool in bore 18*a* is higher than pressure in cavity 50 the resulting mechanical force forces piston shaft 18*a* and spline shaft 16*a* down (to the right) while reaction force acts up (to the left). The resulting acceleration of the parts of drill string above and below (MPT-1) 5 will be a function of mass, amplitude, and combined piston areas. When the drill collar section is not connected below the Pulsar 2 or below (MPT-2) 5 and instead there is only a short bit sub (not shown) and drill bit 4, a novel method of drilling can be implemented. The relatively large mass of the drill collar section above the (MPT-2) 5 will greatly reduce acceleration up (to the left) during a high pressure pulse while acceleration of the bit 4, which has a relatively low mass down (to the right) will be significantly higher. This method will be most useful when drilling horizontal wells where large weight on the drill bit is not available.

Figure 6:
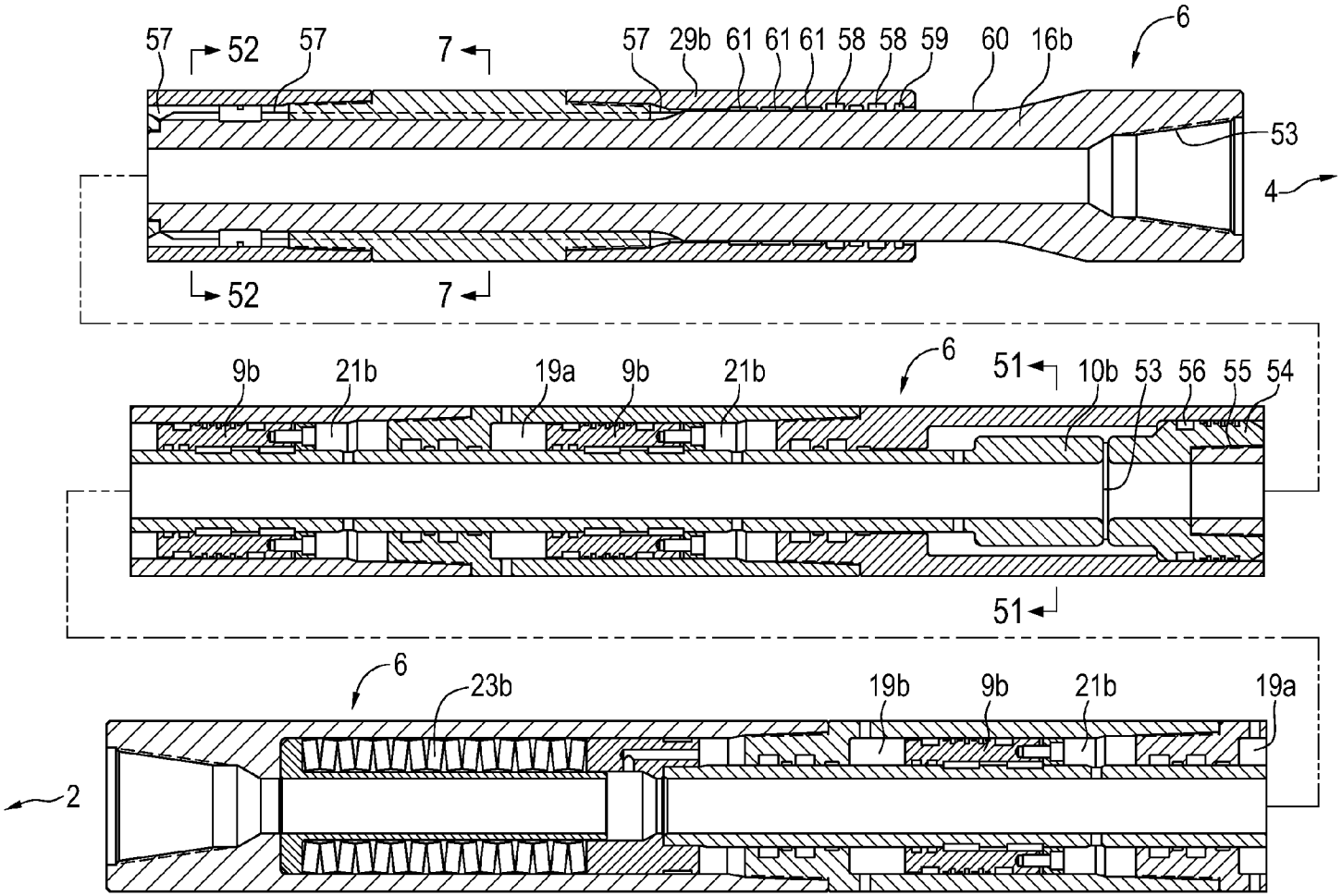
FIG. 6 is a cross section of a Multiple Pistons Mud Hammer Tool.

FIG. 6 is a schematic view of (MPMT) 6. Design of the (MPMT) 6 above the line 51 (to the left) can be identical to that of the (MPT-2) 3 as show in FIG. 4. The design of (MPMT) 6 below the line 52 can be identical to the design of (MPT-2) 3 as shown in FIG. 4 except that male thread 17 is replaced by female thread 53. Into this female thread 53 is connected drill bit 4.

Piston shaft 10*b* is not connected to spline shaft 53. While the pressure in cavities 21*b* is higher than the pressure in 19*b* the whole assembly comprising piston shaft 10*b* and piston 9*b* are lifted up (to the left) and spring stack 23*b* is compressed. When the pressure in cavities 21*b* is lower than the pressure in cavities 19*b*, the stored mechanical energy in the disk springs stack 23*b* forces multiple piston assembly 10*b* and 9*b* down (to the right). Bottom part 53 of the multiple piston shaft 10*b* acts as a hammer while seal nut 54 acts as an anvil. Seal nut is connected to the top end of spline mandrel 16*b* by a threaded connection 55. This connection 55 may provide a sealing function as well.

"O" ring seals of rubber or other suitable materials may be incorporated, if desired. Seal 56 prevents drilling fluid from entering cavity 57 which is usually filled with grease or oil. Seals 58 prevent entry of drilling fluid from the annulus of the well bore into cavity 57. Seals 58 prevent entry of drilling fluid from the annulus of the well bore into cavity 57. Wiper ring 59 scrapes away rough particles that might damage the seals 58. Cylindrical portion 60 outside the splined mandrel 16*b* is plated with hard chrome and ground. Split ring bearing 61 may be made of plastic or bronze to prevent wear caused by the telescopic movement of the splined mandrel 16*b* in seal housing 29*b*. Energy of the repeated blows of the piston shaft 10*b* on the seal nut 54 is transmitted to the bit 4 resulting in increased drilling rates.

Figure 7:
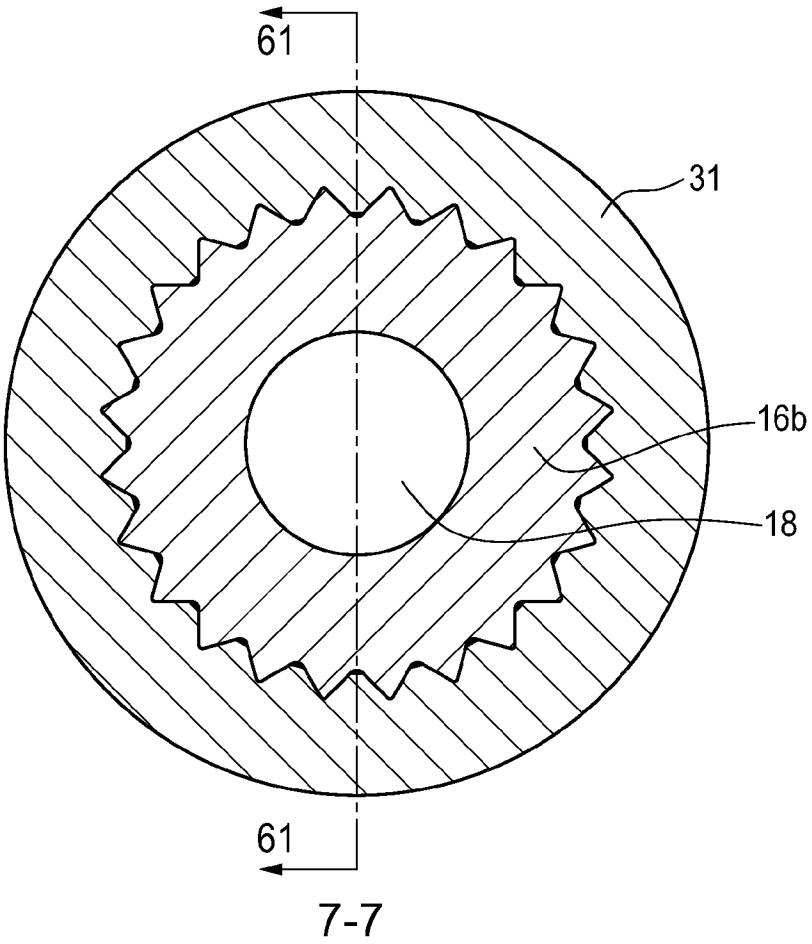
FIG. 7 is a cross section on a line 7-7 of a spline area as may be present in any of the Multiple In Series Pistons Down Hole Tools.

FIG. 7 is a cross section on line 7-7 through the splined mandrel 16*b* and splined housing 31. FIG. 7 also shows an outside housing assembly 62.

Apparatus and methods as described herein may be applied in a wide range of types of drilling operation including 'directional' or 'lateral' drilling.

Where a component (e.g. a seal, collar, drill, assembly, device, tool etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method for underground drilling, the method comprising:

allowing a normal working pressure differential between drilling fluid in a drill string and a bore hole in which the drill string extends to act on pistons in one or more multiple in-series pistons down hole tools in the drill string to compress a spring stack;

generating negative pressure pulses with a pressure pulse generating tool; and, allowing the negative pressure pulses to act on the pistons of the one or more multiple in-series pistons down hole tools to allow mechanical energy stored in the spring stack to apply mechanical force to the drill string; and, allowing the mechanical force to do work;

wherein the normal working pressure differential is a pressure differential at the multiple in-series pistons down hole tools, in the absence of the pressure pulses, resulting from hydrostatic pressure of the drilling fluid within the drill string and pumping of the drilling fluid though the drill string.

2. The method according to claim 1 wherein the work comprises transmitting oscillating mechanical force into the drill string.

3. The method according to claim 1 wherein the work comprises transmitting oscillating mechanical force directly to a drill bit to increase drilling rate.

4. The method according to claim 1 wherein generating the pressure pulses is performed with a down hole pressure pulse generating tool coupled in the drill string.

5. The method according to claim 1 comprising, on the occurrence of the negative pulses, allowing the spring to push a part of the drill string that is below the one or more multiple in-series pistons down hole tools downward in the bore hole.

6. A drill string comprising a drill bit, a pressure pulse generating tool upstream from the drill bit, the pressure pulse generating tool operable to generate negative pressure pulses and one or more multiple in-series pistons down hole tools between the pressure pulse generating tool and the drill bit wherein the one or more multiple in-series pistons down hole tools comprise a spring stack having a spring rate such that the spring stack is compressed as a result of a normal working pressure differential at a location of the multiple in-series pistons down hole tools the normal working pressure differential between drilling fluid in the drill string and a bore hole in which the drill string extends and wherein the normal working pressure differential is a pressure differential at the multiple in-series pistons down hole tools, in the absence of the pressure pulses, resulting from hydrostatic pressure of the drilling fluid within the drill string and pumping of the drilling fluid though the drill string.

7. The drill string according to claim 6 comprising a section of drill collars located upstream from the one or more multiple in-series pistons down hole tools.

8. The drill string according to claim 6 comprising a section of drill collars located downstream from the one or more multiple in-series pistons down hole tools and upstream from the drill bit.

9. The drill string according to claim 6 wherein the one or more multiple in-series pistons down hole tools comprise a plurality of multiple in-series pistons down hole tools coupled together in series with one another.

10. The drill string according to claim 6 wherein the pressure pulse generating tool comprises a down hole pressure pulse generating tool coupled in the drill string.

* * * * *